US011543110B2

(12) United States Patent
Horne

(10) Patent No.: US 11,543,110 B2
(45) Date of Patent: Jan. 3, 2023

(54) LIGHTING SYSTEM

(71) Applicant: Alliance Sports Group, L.P., Fort Worth, TX (US)

(72) Inventor: Gregory Lee Horne, Euless, TX (US)

(73) Assignee: Alliance Sports Group, L.P., Roanoke, TX (US)

( * ) Notice: Subject to any disclaimer, the term of this patent is extended or adjusted under 35 U.S.C. 154(b) by 0 days.

(21) Appl. No.: 17/183,981

(22) Filed: Feb. 24, 2021

(65) Prior Publication Data

US 2021/0207793 A1 Jul. 8, 2021

Related U.S. Application Data

(63) Continuation-in-part of application No. 16/747,363, filed on Jan. 20, 2020, now Pat. No. 11,076,460.

(60) Provisional application No. 62/794,047, filed on Jan. 18, 2019.

(51) Int. Cl.

| | |
|---|---|
| ***F21V 23/04*** | (2006.01) |
| ***F21L 4/02*** | (2006.01) |
| ***H05B 45/325*** | (2020.01) |
| ***H05B 47/10*** | (2020.01) |

(52) U.S. Cl.

CPC ..... *F21V 23/0414* (2013.01); *F21L 4/027* (2013.01); *F21V 23/0442* (2013.01); *H05B 45/325* (2020.01); *H05B 47/10* (2020.01)

(58) Field of Classification Search

CPC ..... H05B 47/10; H05B 47/11; H05B 47/16; H05B 47/17; H05B 47/165; H05B 45/10; H05B 45/14; H05B 45/20; H05B 45/30; H05B 45/32; H05B 45/45; H05B 45/325; F21V 23/0414; F21V 23/0442; F21V 4/027

See application file for complete search history.

(56) References Cited

U.S. PATENT DOCUMENTS

| | | | | |
|---|---|---|---|---|
| 5,469,346 | A | 11/1995 | Haut et al. | |
| 6,055,766 | A * | 5/2000 | Nolen | A01M 1/023 43/112 |
| 6,134,826 | A * | 10/2000 | Mah | A01M 1/223 43/99 |
| 7,360,921 | B1 | 4/2008 | Greenspon | |
| 8,638,074 | B2 * | 1/2014 | Babcock | H02M 1/425 363/125 |
| 10,393,325 | B2 | 8/2019 | Oh | |
| 2002/0047009 | A1 * | 4/2002 | Flugstad | A23B 9/04 219/771 |

(Continued)

FOREIGN PATENT DOCUMENTS

| | | |
|---|---|---|
| CN | 204014833 | 12/2014 |
| EP | 2158141 | 5/2013 |

(Continued)

OTHER PUBLICATIONS

International Search Report dated Sep. 24, 2018, in International Application No. PCT/US18/35599, filed Jun. 1, 2018; 16 pages.

*Primary Examiner* — Abdullah A Riyami
*Assistant Examiner* — Syed M Kaiser
(74) *Attorney, Agent, or Firm* — Thorpe North & Western, LLP; Jed H. Hansen

(57) ABSTRACT

A lighting device is disclosed with one or more magnetic control switches to adjust the power modes of the lighting device.

7 Claims, 14 Drawing Sheets

(56) References Cited

U.S. PATENT DOCUMENTS

2002/0139984 A1* 10/2002 Sugawara ..... H01L 33/08 257/79
2004/0070352 A1* 4/2004 Shen ..... H05B 41/3928 315/291
2006/0237636 A1* 10/2006 Lyons ..... F21S 10/02 250/228
2006/0262526 A1* 11/2006 Dubois ..... F21L 14/023 362/399
2007/0146958 A1* 6/2007 Babcock ..... H02P 7/281 361/160
2007/0159008 A1* 7/2007 Bayat ..... F21V 29/75 307/112
2008/0034642 A1* 2/2008 Chen ..... A01M 1/04 43/112
2009/0190338 A1* 7/2009 Huang ..... F21L 4/00 362/240
2011/0133655 A1* 6/2011 Recker ..... H02H 3/08 315/159
2011/0157942 A1* 6/2011 Babcock ..... H02M 1/425 363/126
2012/0212963 A1* 8/2012 Jigamian ..... F21V 14/045 362/280
2013/0165226 A1* 6/2013 Thorner ..... A63F 13/285 463/37
2014/0062298 A1* 3/2014 Brockett ..... H05B 41/2813 315/39
2015/0167937 A1* 6/2015 Casper ..... H05B 45/14 362/373
2016/0101227 A1* 4/2016 Norris ..... G01V 8/20 604/29
2016/0348880 A1* 12/2016 Galli ..... F21V 23/0421
2017/0002994 A1 1/2017 Fisher et al.
2017/0094744 A1* 3/2017 Chen ..... H05B 45/14
2017/0094960 A1 4/2017 Sasaki et al.
2017/0208661 A1* 7/2017 Hussain ..... H05B 45/10
2017/0223807 A1* 8/2017 Recker ..... H05B 45/20
2018/0106616 A1* 4/2018 Jiang ..... H01S 5/042
2018/0147386 A1* 5/2018 Sato ..... F21V 7/0008
2018/0194021 A1* 7/2018 Nguyen ..... B26B 1/08
2018/0312105 A1* 11/2018 Bartell ..... B60Q 1/445
2019/0150249 A1* 5/2019 Bertken ..... H04Q 9/00 315/149
2019/0313500 A1* 10/2019 Stevens, Jr. ..... H05B 45/327

FOREIGN PATENT DOCUMENTS

KR 20090054653 A * 6/2009 ..... G01F 15/065
KR 20-2013-0006888 12/2013
KR 10-1545083 8/2015
KR 10-1711395 3/2017
WO WO 2008/156594 12/2008

* cited by examiner

LIGHTING SYSTEM

PRIORITY CLAIM

The present application claims priority to U.S. Ser. No. 62/794,047 filed on Jan. 18, 2019 entitled "Improved Lighting System" and U.S. Ser. No. 16/747,363 filed on Jan. 20, 2020 entitled "Lighting System" which are both incorporated herein by reference in their entirety.

FIELD OF THE INVENTION

The present invention relates generally to lighting devices, systems, and associated methods and more particularly to an improved apparatus and system for providing utilitarian light in low light environments.

BACKGROUND

A typical human eye will respond to wavelengths of light from about 390 to 700 nanometers (i.e., white light). Certain handheld lights or other lights used for a variety of different purposes can emit very high levels of bright white light. However, in dark environments the human eye expands the pupils to absorb as much light as possible since the ambient light level is very low. When the user turns on these flashlights with the HIGH output as the default starting mode—the user's pupils will contract quickly to protect the eye's imaging receptors. This is an automatic biological reaction to the change in lighting levels. This will lower the user's visual sensitivity to the existing dark ambient environment. Aspects of the current technology permit a user a low-level light option to see equipment such as maps without giving away their position while also having the option of a high-level light for other uses. Other aspects of the technology provide for magnetic selection of power modes. These aspects also result in less consumption of battery resources.

BRIEF DESCRIPTION OF THE DRAWINGS

To further clarify the above and other aspects of the present technology, a more particular description of the invention will be rendered by reference to specific aspects thereof which are illustrated in the appended drawings. It is appreciated that these drawings depict only typical aspects of the technology and are therefore not to be considered limiting of its scope. The drawings are not drawn to scale. The technology will be described and explained with additional specificity and detail through the use of the accompanying drawings in which.

DESCRIPTION OF EMBODIMENTS

Figure 1:
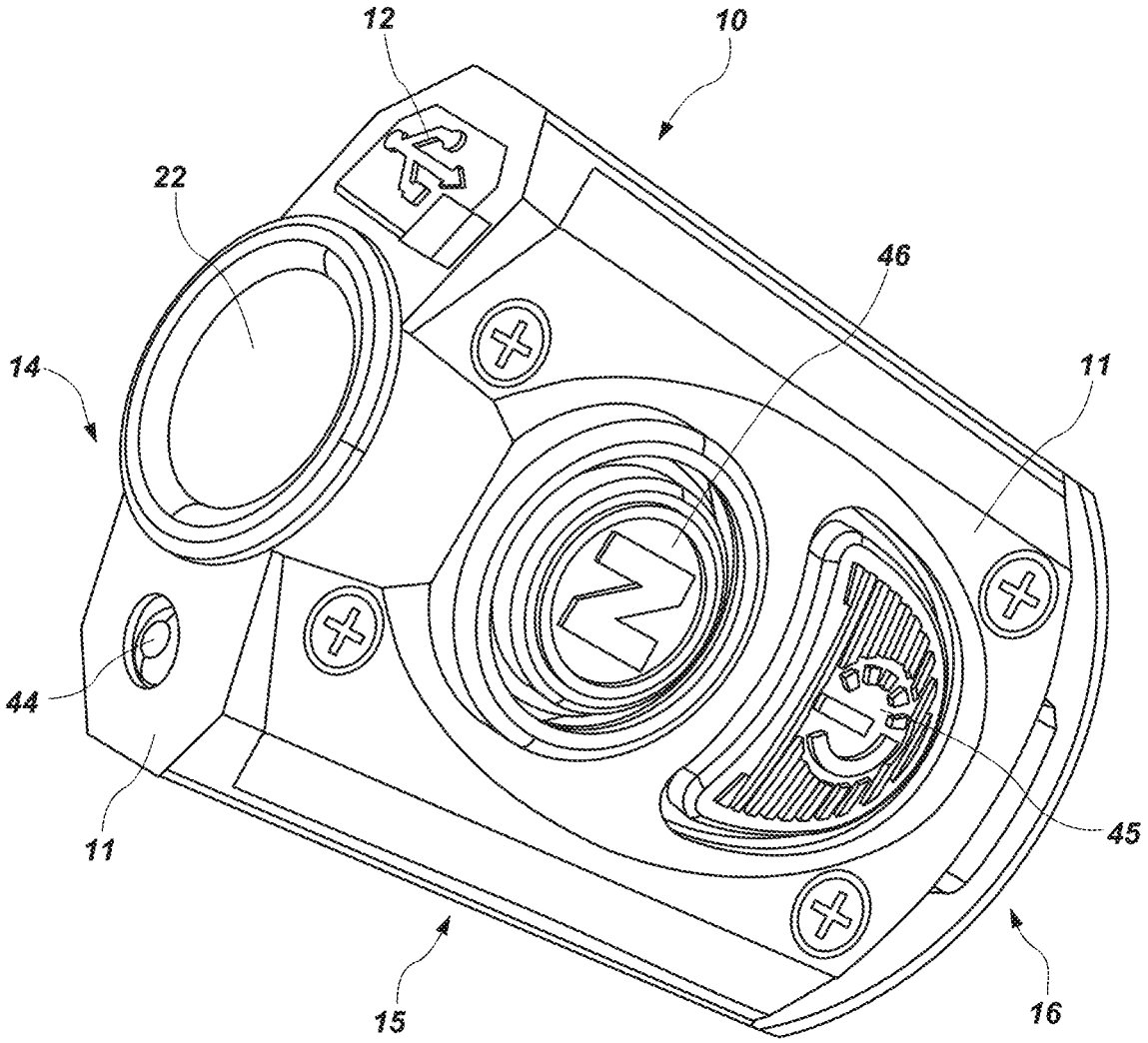
FIG. 1 is a perspective view of a lighting device in accordance with one aspect of the technology.
Figure 2:
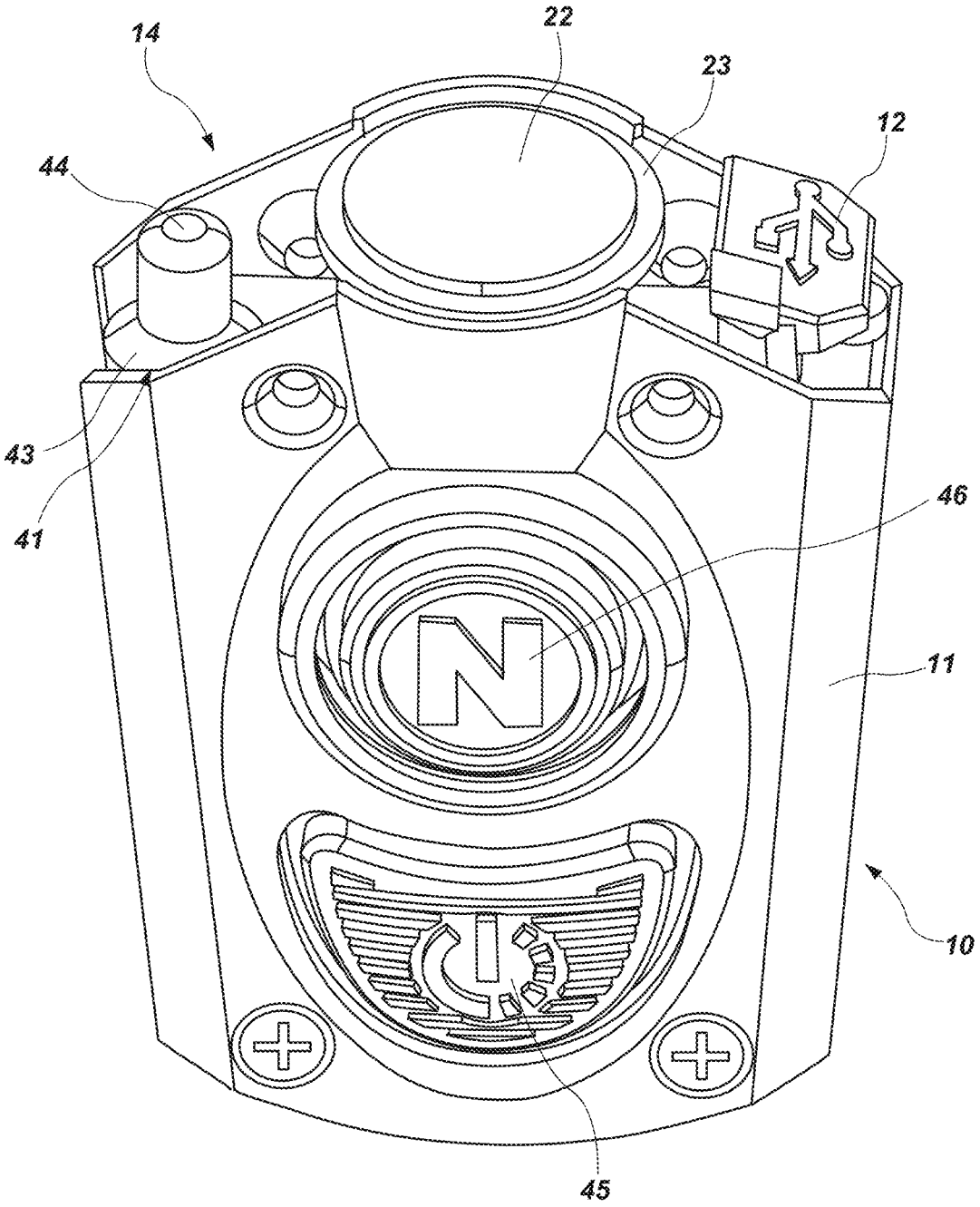
FIG. 2 is a perspective view of a lighting device in accordance with one aspect of the technology.
Figure 3:
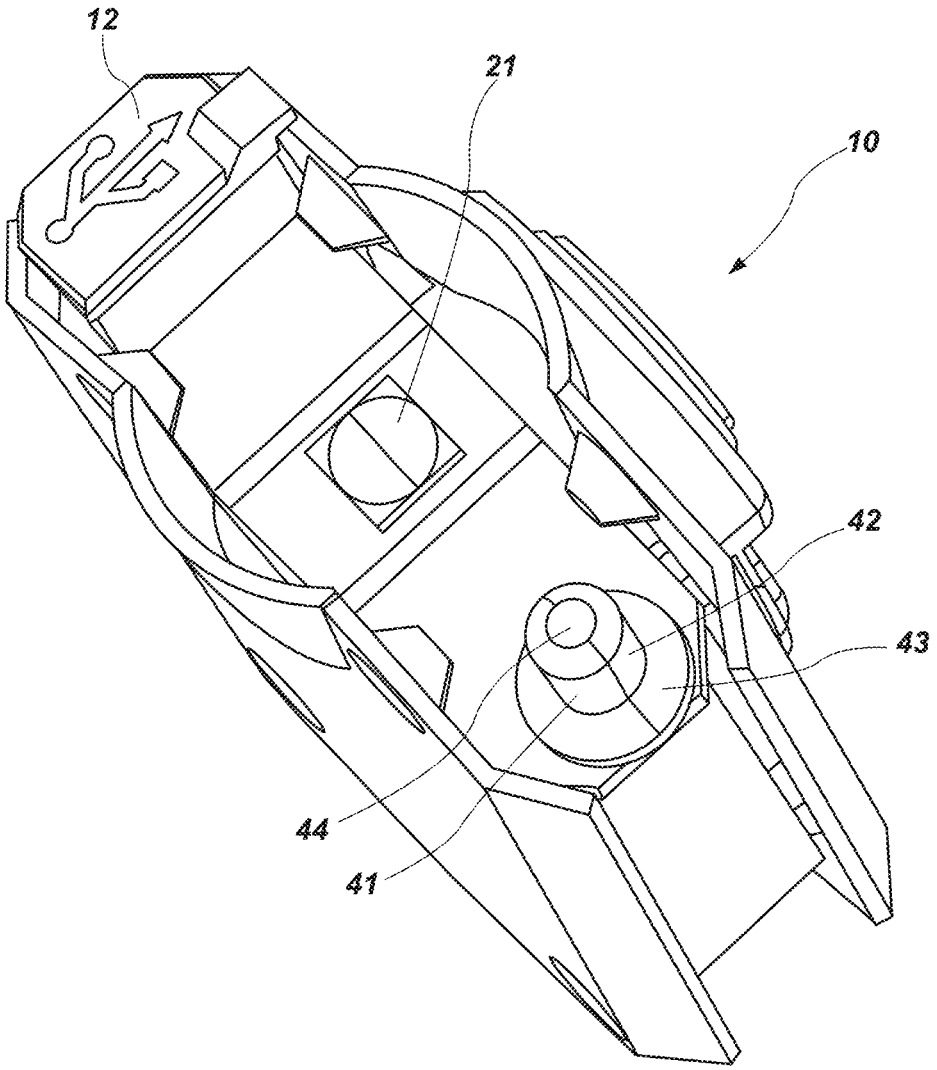
FIG. 3 is a perspective view of a lighting device in accordance with one aspect of the technology.
Figure 4:
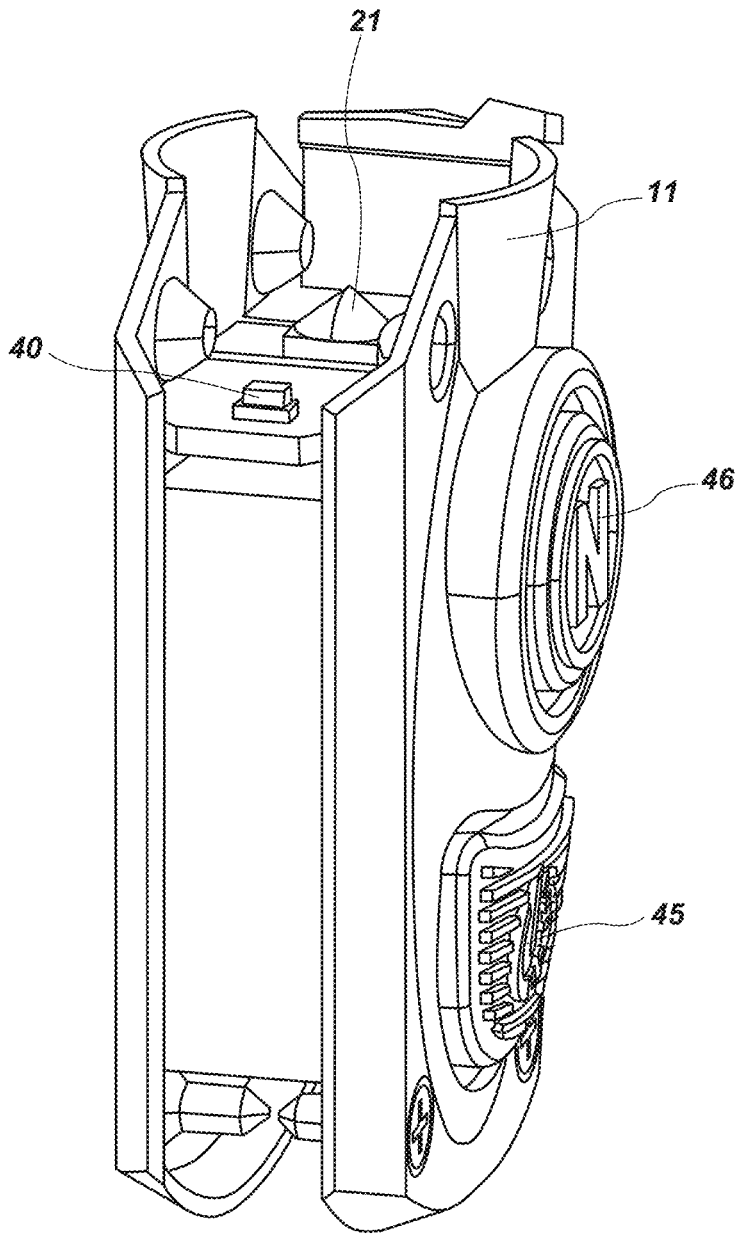
FIG. 4 is a perspective view of a lighting device in accordance with one aspect of the technology.
Figure 5:
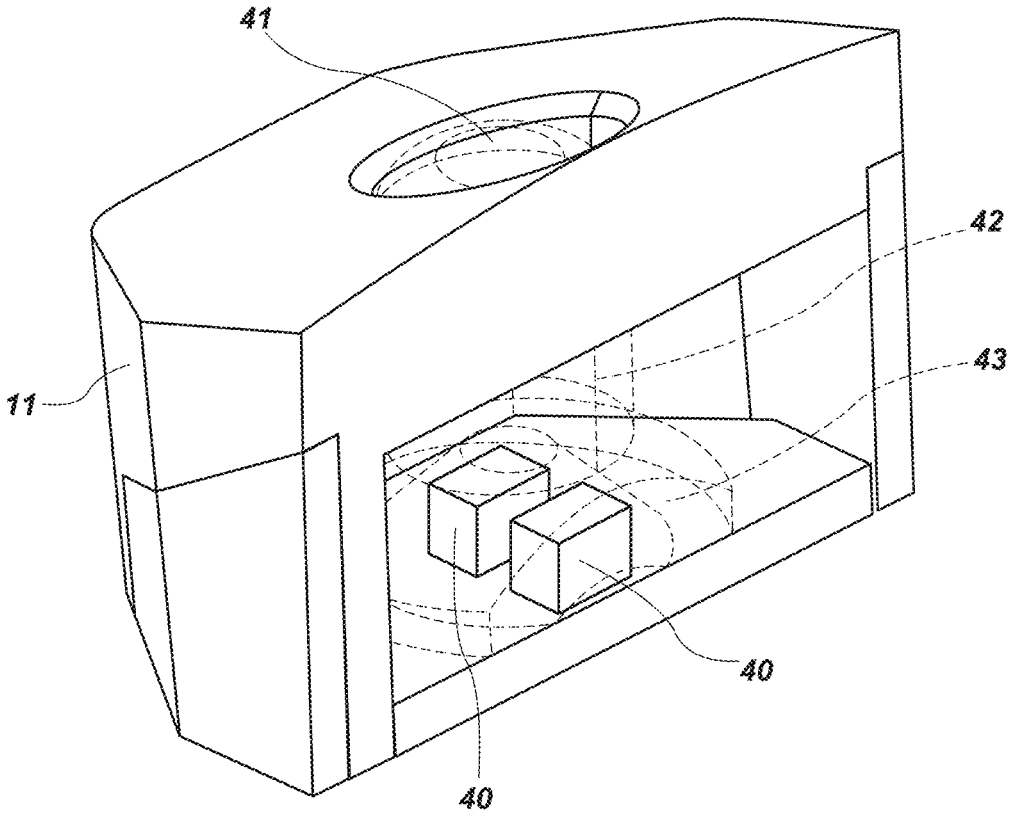
FIG. 5 is a cross section view of a portion of a lighting device in accordance with one aspect of the technology.

Although the following detailed description contains many specifics for the purpose of illustration, a person of ordinary skill in the art will appreciate that many variations and alterations to the following details can be made and are considered to be included herein. Accordingly, the following embodiments are set forth without any loss of generality to, and without imposing limitations upon, any claims set forth. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the compositions nature or characteristics would be permissible if present under the "consisting essentially of" language, even though not expressly recited in a list of items following such terminology. When using an open ended term, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that any terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint. Unless otherwise stated, use of the term "about" in accordance with a specific number or numerical range should also be understood to provide support for such numerical terms or range without the term "about". For example, for the sake of convenience and brevity, a numerical range of "about 50 angstroms to about 80 angstroms" should also be understood to provide support for the range of "50 angstroms to 80 angstroms."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Reference in this specification may be made to devices, structures, systems, or methods that provide "improved" performance. It is to be understood that unless otherwise stated, such "improvement" is a measure of a benefit obtained based on a comparison to devices, structures, systems or methods in the prior art. Furthermore, it is to be understood that the degree of improved performance may vary between disclosed embodiments and that no equality or consistency in the amount, degree, or realization of improved performance is to be assumed as universally applicable.

EXAMPLE EMBODIMENTS

An initial overview of technology embodiments is provided below and specific technology embodiments are then described in further detail. This initial summary is intended to aid readers in understanding the technology more quickly, but is not intended to identify key or essential features of the technology, nor is it intended to limit the scope of the claimed subject matter.

Broadly speaking, aspects of the disclosed technology create a unique and improved utilitarian light configured and equipped with a switch for control of light mode operations to optimize battery usage in low-light or dark environments. In certain aspects of lighting technology, when a light is in an OFF position, the light can be turned to an ON position to the highest lighting level upon the initial "press" of the mode switch or power switch. Additional presses of the switch (or otherwise sequencing through the logic controls of the lighting device) step through available lower lighting modes until all the modes have been exhausted or, in other words, when the next press or sequence will turn the lighting device into an OFF mode. In one example of a handheld light, the sequence of mode settings is configured to be high, medium, low, and OFF. Other non-limiting examples include high, high strobe, medium, medium strobe, low, low strobe, OFF. In one aspect, this initial sequencing occurs when, beginning in the OFF mode, the user presses the power switch for less than ½ second.

In aspects of the current technology, when the light is in the OFF position, the user can hold the mode switch for more than ½ second (or some other predetermined period of time programmed into the logic controller) before releasing the switch to initiate the operations mode to start an alternative sequence. In one aspect, this sequence begins from the lowest level of lighting so that the output of the lighting device will not significantly interfere with the response of the human eye to a bright light in a dark or low light environment. That is, in one aspect of the technology, the light is configured such that the first light mode in the sequence is the lowest amount of light available from a particular light source (e.g., an LED). In another aspect, the light is configured such that the first light mode propagates a specific wavelength of light (e.g., a wavelength corresponding to the color red), again, intended to minimize the impact on the eyes of the user.

A typical human eye will respond to wavelengths of light from about 390 to 700 nanometers (i.e., white light). Certain handheld lights or other lights used for a variety of different purposes can emit very high levels of bright white light. However, in dark environments the human eye expands the pupils to absorb as much light as possible since the ambient light level is very low. When the user turns on these flashlights with the HIGH output as the default starting mode—the user's pupils will contract quickly to protect the eye's imaging receptors. This is an automatic biological reaction to the change in lighting levels. This will lower the user's visual sensitivity to the existing dark ambient environment even if the flashlight's output levels are set to a lower level after the initial turn ON. By starting the light output in the lower output level, the user's eyes will perceive the low-level light as a much brighter light source than it would have been otherwise perceived since the user's pupils are still expanded. This conserves battery resources as the user will be able to read and/or operate with minimal light having already acclimated to the low-light environment. This is also beneficial for tactical purposes, such as a stealth mode. Many police, military personnel, sportsmen, or other outdoor enthusiasts do not want to give up their position in a dark environment. Aspects of the current technology permit a user a low-level light option to see equipment such as maps without giving away their position while also having the option of a high-level light for other uses.

In an additional aspect of the technology, the hand held flashlight is equipped with multi-use LEDs (MLEDs). In one aspect of the technology, the MLEDs comprise LEDs configured to propagate light in a plurality of different wavelengths of light corresponding to specific colors. On many devices, these colors are used to help the user understand an operation condition of the lighting device (or other product), including, but without limitation, charge status, or other operational status (e.g., ON/OFF, WIFI enabled, etc.). These indicator lights are low power, diffuse LEDs to limit the amount of light propagated from the device. This limits the amount of battery power used by the LED to perform its function of a status or operational indicator. In one aspect of the technology, MLEDs are used not only as a status or operational indicator, but as a useable source of light. In one aspect, the MLEDs are configured to communicate with a logic controller that modifies the pulse-width-modulation (PWM) of the MLED to increase the perceived lumen output and hence the functionality of the light to the user. For example, in "indication mode" the MLED has a first PWM cycle but in a "bright mode," the MLED has a second and/or third PWM cycle. In dark environments where a conventional LED "status indicator" might normally provide some, but not enough, light to read a map or otherwise help a user, the MLED satisfies that need. In addition to a different PWM cycle, in one aspect of the technology, the lens used in connection with the MLED is optimized for focus light, rather than diffused light.

With reference now to the figures, FIGS. 1 through 5 illustrate one example of a hand-held lighting device 10. The lighting device 10 generally comprises an outside housing 11 configured with a cavity for a rechargeable power source (e.g., a battery), a primary light source 21, one or more secondary light sources 40, a control switch 45, and a logic controller such as a programmable logic controller or PLC. A PLC is a digital computer used for automation of certain electromechanical processes, such as control of machinery on factory assembly lines, amusement rides, or light fixtures. PLCs are designed for multiple arrangements of digital and analog inputs and outputs, extended temperature ranges, immunity to electrical noise, and resistance to vibration and impact. In one aspect of the technology, the instructions to control operation of the lighting device operation are stored in battery-backed-up or non-volatile memory. Memory refers to electronic circuitry that allows information, typically computer data, to be stored and retrieved.

As will be appreciated by one skilled in the art, aspects of the present technology may be embodied as a system, method or computer program product used in connection with a lighting device. Accordingly, aspects of the present technology may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a random access memory (RAM), a read-only memory (ROM), an erasable programmable read-only memory (EPROM or Flash memory), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present technology may be written in any combination of one or more programming languages, including an object oriented programming language such as Java, Visual Basic, SQL, C++ or the like and conventional procedural programming languages, such as the "C" programming language or similar programming languages.

With reference generally to FIGS. 1 through 5, one aspect of the technology, the primary light source comprises an LED 21 disposed at the tip of an inverted truncated cone. In one aspect of the technology, an inside surface of the inverted truncated cone is covered with a reflective coating to enhance and focus propagation of light emanating from LED 21. A charging port 12 that can be connected to an external power source to recharge the battery is disposed on a front 14 of the lighting device 10 near a lens 22 covering LED 21. However, the charging port 12 can be disposed in a convenient location on the device. Lens 22 is framed within the internal circumference of the base 23 of the inverted truncated cone associated with LED 21. In aspect of the technology, a one or more multi-use LEDs ("MLED") comprise the secondary light source 40. The secondary light source 40 is disposed on a front side 14 of the lighting device 10 opposite the charge port 12 and near the lens 22. In this manner, the direction of light propagated from the secondary light source 40 is in a direction that is parallel with a direction of light propagated or emitted from the primary light source 21. However, the secondary light source 40 can be oriented so that the light emitted from said light source is in a different direction than the primary light source 21. For example, the secondary light source 40 can be disposed on a bottom 16 of the lighting device 10 or a side 15 of the lighting device 10 as suits a particular purpose.

In one aspect of the technology, the secondary light source is housed within a lens 41 having a substantially cylindrical body 42. A base 43 of the lens 41 is sized to encapsulate one or more MLEDs and concentrate light from the LEDs through the body 42 of the lens 41 and out the distal end 44 of the lens 41. In one aspect of the technology, the base 43 approximates the shape of a truncated cone that is larger in diameter than the diameter of the body 42. However, in other aspects, the base 43 may have the same diameter as the body 42 depending on the number of MLEDs and or the desired size of the distal end 44 of lens 41.

In one aspect of the technology, the PLC is configured to regulate the pulse-width-modulation (or PWM) of the LED 21 at a plurality of different duty cycles in a plurality of different sequences. PWM is one way of regulating the brightness of a light. In one aspect, light emission from the LED is controlled by pulses wherein the width of these pulses is modulated to control the amount of light perceived by the user of the lighting device. When the full direct current voltage runs through an LED, the maximum of light is emitted 100% of the time. That is, the LED 21 emits light 100% of the time when in an "ON" mode. With PWM, the voltage supplied to the LED 21 can be "ON" 50% of the time and "OFF" 50% of the time so that the LED 21 gives off its maximum amount of light only 50% of the time. This is referred to as a 50% duty cycle. In this scenario, if the ON-OFF cycle is modulated fast enough, human eyes will perceive only half the amount of light coming from the LED 21. That is, with such an input on the LED 21, the amount of light given off appears diminished by 50%. While specific reference is made to a 50% duty cycle, the LED 21 duty cycle of the light sources described herein may be greater or lesser than 50% as suits a particular purpose. In one aspect, the PLC, power source, control switch 45, and different light sources are all operably coupled together.

Figure 6:
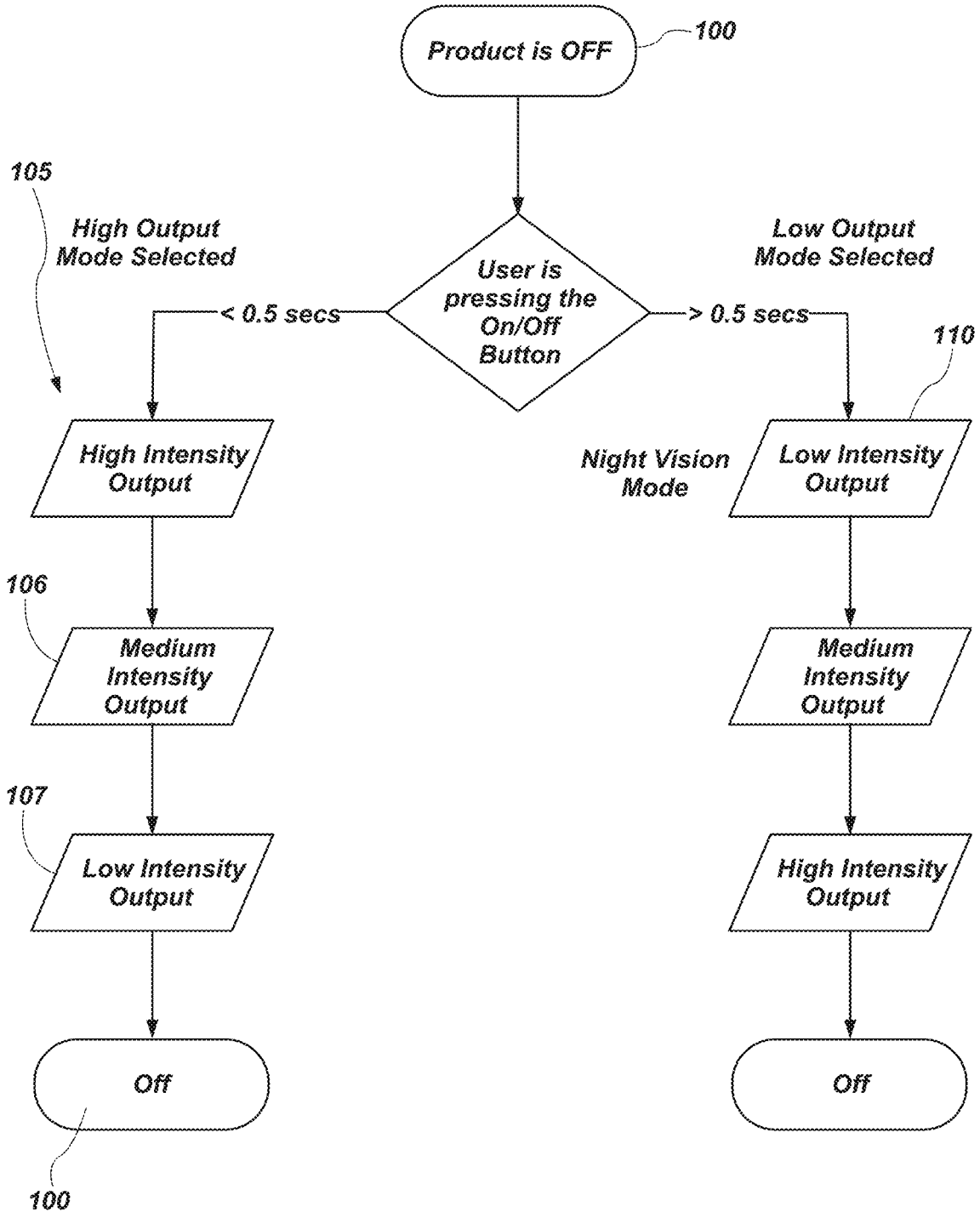
FIG. 6 is a flow chart illustrating a functional sequence of lighting of a lighting device in accordance with one aspect of the technology.

With reference now to FIG. 6, a flow diagram is shown that illustrates the different light sequencing modes of a lighting device programmed into the PLC in accordance with one aspect of the technology. Beginning in the OFF mode 100, if a user depresses the activation or on switch for less than a predetermined period of time (e.g., 0.25 seconds, 0.5 seconds, 0.75 seconds, or any range there between, etc.), the "bright first mode" 105 is activated. In the bright first mode, the LED 21 is activated in a HIGH mode, or a mode with the highest PWM setting. Subsequent activation of the power switch cycles the light through different modes, such as a MEDIUM 106 and LOW 107 modes. In one aspect of the technology, the PWM for the HIGH, MEDIUM, and LOW modes (or first, second, and third power modes) is set at a duty cycle of about 75%, 50%, and 25%, respectively, though other duty cycles may be used. In one aspect, the duty cycle for the first power mode ranges from about 70% to 80%, the second power mode ranges from about 45% to 55%, and the third power mode ranges from about 20% to 30%.

If, beginning from the OFF mode 100, the user depresses the activation switch for greater than the predetermined period of time, a "bright last mode" 110 is activated. In this aspect, the LED 21 is activated in LOW mode first 110 and then cycles to higher duty cycles with each successive activation of the switch. While specific examples of PWM duty cycles are provided, it is understood that any number of different duty cycles may be programmed into the PLC and used in connection with the primary LED 21 such that the terms LOW, MEDIUM, and HIGH, as they are used herein are not limited to the specific PWMs listed. The duty cycle need not be limited to a single LED 21. For example, one or more LEDs can be located adjacent LED 21 configured to operate at different duty cycles, or different wavelengths of light. In this manner, the "bright last mode" can include activation of a red or green LED, for example, that is activated first in the event the user wishes to start a lighting sequence with a light that is not only dim, but not colored white in an effort to minimize detection. The light sequence would then cycle through the other operational modes ending with a HIGH mode.

Figure 7:
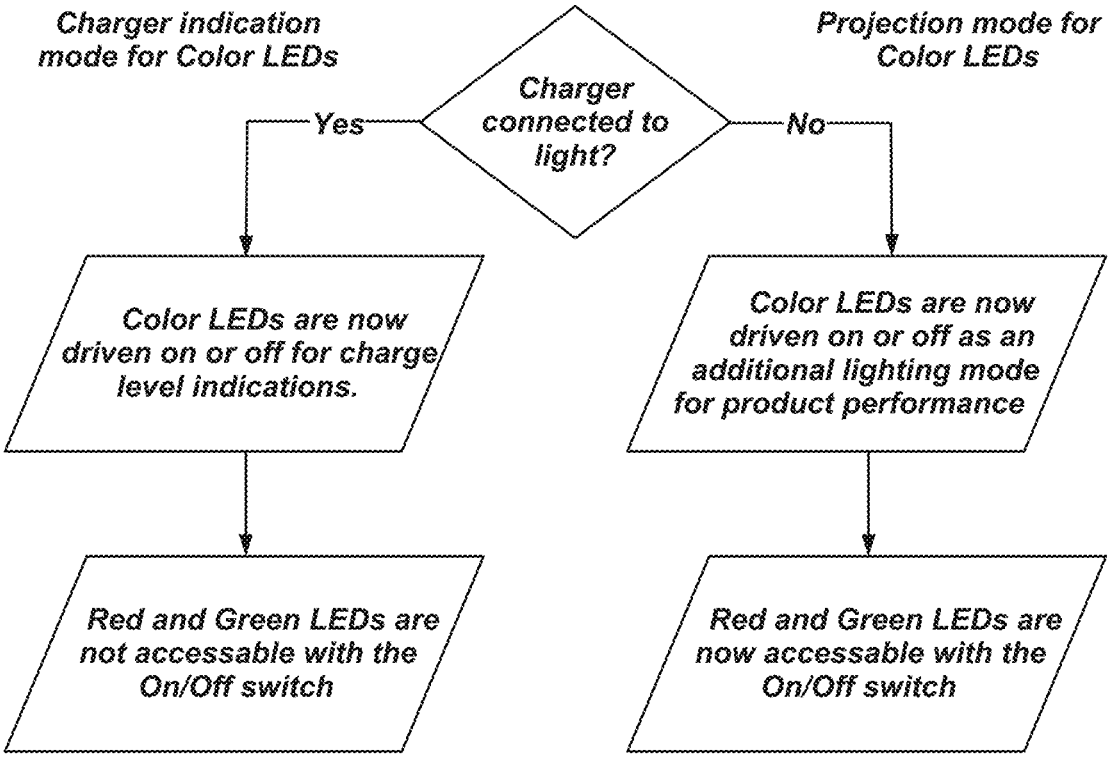
FIG. 7 is a flow chart illustrating a functional sequence of lighting of a lighting device in accordance with one aspect of the technology.

With reference generally to FIG. 7, a lighting device is equipped with a secondary light source 40 comprising multi-use LEDs (MLEDs). In one aspect of the technology, the MLEDs comprise LEDs configured to propagate light in a red (about 620 nm to about 750 nm), green (about 495 nm to about 570 nm), blue (about 450 m to about 495 nm), or other colored band. The colors are used to help the user understand an operation condition of the lighting device (or other product), including, but without limitation, charge status, or other operational status (e.g., ON/OFF, wi-fi connected, etc.). For example, a red light near a charging port can indicate that the internal battery requires charging. A green light near the charging port can indicate that the battery is fully charged. A blue light can indicate that the device is receiving a wireless or other signal. These indicator lights are low power, diffuse LEDs. The low power, diffuse nature of the LEDs limits the amount of light propagated from the device which in turn limits the amount of battery power used by the LED to perform its function of a status or operational indicator.

In one aspect of the technology, MLEDs 40 are used not only as a status or operational indicator, but as a useable source of light. In one aspect, the MLEDs 40 are configured to communicate with the PLC that modifies the pulse-width-modulation (PWM) of the MLEDs 40 to increase the perceived brightness and hence the functionality of the light to the user. For example, in "indication mode" the MLED 40 has a first PWM cycle of 30%, but in a "bright" mode, the MLED 40 has a second and/or third PWM cycle of 60% and/or 80% so that the MLED provides more light to the user than would be necessary for an "indication mode" function. The duty cycles may differ as suits a particular application. For example, the first PWM duty cycle may range from 20% to 40%, the second from 50% to 70%, and the third from 70% to 90%.

In one aspect of the technology, the MLEDs 40 are coupled to a PLC configured to modify the PWM of the MLEDs according to a pre-determined sequence programmed into the PLC. In one aspect, the modification of the lighting of the MLEDs may be activated by a user only when a charger, for example, is not connected to the charge port 12 of the lighting device 10. Meaning, if the MLEDs are functioning as a status indicator (e.g., device is charging, device is connected to wi-fi, etc.), the PLC prevents the MLEDs 40 from being operated in "bright mode." In this mode, the PWM of the MLEDs cannot be changed. Rather, the MLEDs 40 function in a default PWM where the brightness corresponds to a conventional status indicator. In one aspect of the technology, a separate power switch 46 is used to bypass the sequencing operations of the PLC and activates the primary light source 21 in its highest operating mode. In this manner, if a user does not wish to cycle through any modes of operation, including a low-light mode, the user may activate the bypass power switch 46 to turn on the brightest operating mode of the primary light 21.

In one aspect of the technology, LED lights require a driver in order to provide/deliver a desired output. The driver may be internally or externally incorporated into the LED and can be either constant current or constant voltage. Both constant current and constant voltage drivers act as a power supply for an LED light source. LED drivers provide and regulate the necessary voltage in order to maintain operation of the LED. In one aspect of the technology, a constant current LED driver operates within a range of output voltages and a fixed output current (amps). An LED is rated to operate at a forward voltage with an associated current, and a supply is needed to deliver the required operational voltage and current. In one aspect, a constant current driver varies the voltage along an electronic circuit which allows a constant electrical current through the LED device. In one aspect of the technology, a constant voltage driver operates on a single direct current (DC) output voltage (e.g., 12 VDC or 24 VDC, etc.). The driver will maintain a constant voltage no matter the load current. In one aspect of the technology, the power mode of the lighting device may be changed by changing the current that is available from the LED drive circuitry. In one aspect of the technology, an electronic circuit comprises an overall voltage supply that is high enough to span the number of LEDs in series (e.g., 3.2V is a forward voltage rating for each of three LEDs, etc.), and a 10 Ohm resistor component is used to set the desired current. By varying the resistor, brightness of the LEDs is varied up to the forward current limitation of the LED. Of course, different forward voltage ratings and different resistors, or other circuit components, may be used as a means of regulating constant current in an LED device.

Figure 8:
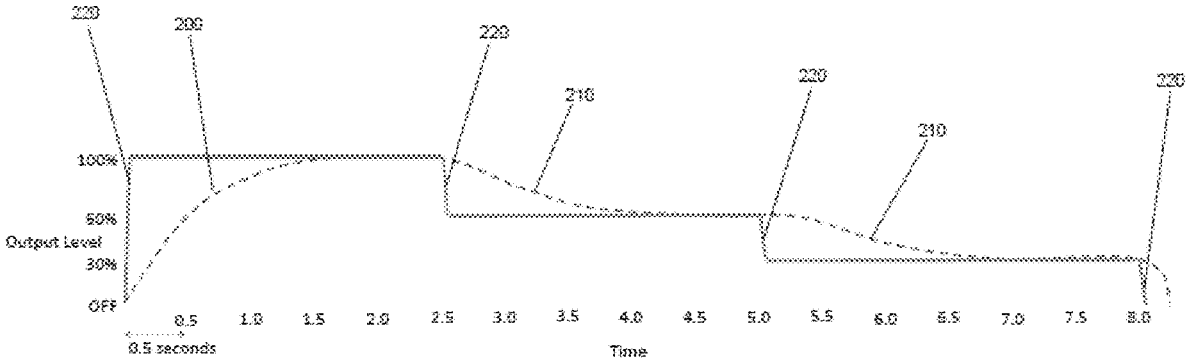
FIG. 8 is a graph illustrating the load control of a lighting device in accordance with one aspect of the technology.

With reference generally to FIG. 8, in one aspect of the technology, a load control transition program is in the PLC of a lighting device. When a lighting mode changes from one mode to another mode (e.g., High Power to Medium Power or vice versa, Medium Power to Low Power or vice versa, a change in PWM cycle, a change in constant current drive, a change in color modes, etc.), the change occurs over a period of time ranging from 800 milliseconds to 1200 milliseconds, though other periods of time may be used (e.g., 500 milliseconds to 3000 milliseconds, etc.). In one aspect, the power is transitioned (e.g., ramped up or ramped down) at a rate ranging from approximately 50% to 70% (or specific rates there between, e.g., 55%, 60%, 65%, etc.) of the load level differential per second, where the differential is defined as the target load level minus the original or beginning load level. In one aspect of the technology, the load transition rate when "ramping up" 200 is greater than the transition rate when "ramping down" 210 and vice versa. In another aspect, the load transition rate when ramping up is the same as the load transition rate when ramping down.

In one aspect of the technology, the amount of power used in a High and Medium Power mode, respectively, ranges from between 4 watts for High Power mode and 1.5 watts for Medium Power mode. In a situation where a light mode is transitioning between different power modes or duty cycles, the slower transition between modes allows the eyes to adjust to the change in brightness. More advantageously, however, less battery power is consumed when the power mode is changed over an extended period of time instead of during a "hard" switch 220. In certain aspects of the technology, the transition from one energy level to another can both draw and expel large amounts of energy as circuits can be resistive to load current changes due to typical embedded technologies such as voltage boost circuits. For example, during a "hard" or direct switch between load levels, instantaneous power consumption can be as high as 5 watts. To combat these changes, clamping circuitry such as a clamping diode can be deployed to capture the energy and dissipate it. Other complex energy management circuits can also be used to protect surrounding components from energy surges that are generated during the step function. Advantageously, aspects of the currently technology allow the power to be slowly adjusted between the different modes without complex energy management circuits. In one aspect, using the "ramping up," or "ramping down" technology, the instantaneous power consumption would not exceed the normal operational power load of 4 watts.

It is noted that no specific order is required in these methods unless required by the claims set forth herein, though generally in some embodiments, the method steps can be carried out sequentially.

Magnetic Actuator

Other aspects of the technology comprise a magnetic disk or ring used to change the different power modes selected herein. In one aspect, a magnetic actuator is coupled to a printed circuit board or PCB with sensors disposed about the PCB. As the magnetic disk is rotated, it interacts with the sensors to switch power modes (i.e., on/off, low power, medium power, high power, etc.). In another aspect, the magnetic actuator functions to simple change low power, medium power, or high power modes; the on/off power mode being actuated by a separate switch coupled to the PCB.

Generally speaking, in one aspect of the technology, the lighting device comprises a disk or ring that is rotatably mounted about a portion of the lighting device. In one aspect, the disk or ring comprises a one or more magnets that each comprises a substantially consistent magnetic field and/or a substantially consistent magnetic force. The disk or ring is disposed adjacent a plurality of sensors that detect the magnetic force or magnetic field generated by the one or magnets. As the user rotates the disk or ring, the sensors detect the magnetic field and/or force and adjust the power mode of the lighting device accordingly. In one aspect of the technology, the sensor comprises a Hall-effect sensor or Hall sensor, an inductive sensor, or the like. Generally speaking, are devices which are activated by an external magnetic field. A magnetic field has flux density, (B) and polarity. The output signal from a Hall sensor is the function of magnetic field density around the device. When the magnetic flux density around the sensor exceeds a certain pre-set threshold, the sensor detects it and generates an output voltage called the Hall Voltage.

In one aspect of the technology, the sensors comprises a thin piece of rectangular p-type semiconductor material such as gallium arsenide (GaAs), indium antimonide (InSb) or indium arsenide (InAs) passing a continuous current through itself. When the sensor is placed within a magnetic field, the magnetic flux lines exert a force on the semiconductor material which deflects the charge carriers, electrons and holes, to either side of the semiconductor material. This movement of charge carriers is a result of the magnetic force they experience passing through the semiconductor material. As the electrons and holes move sidewards a potential difference is produced between the two sides of the semiconductor material by the build-up of these charge carriers. The movement of electrons through the semiconductor material is affected by the presence of an external magnetic field which is at right angles to it and this effect is greater in a flat rectangular shaped material.

Generally speaking, Hall sensors and switches are designed to be in the "OFF", (open circuit condition) when there is no magnetic field present. They only turn "ON", (closed circuit condition) when subjected to a magnetic field of sufficient strength and polarity. In one aspect of the technology, the Hall sensor comprises a linear or digital outputs. The output signal for linear (analogue) sensor is taken directly from the output of an operational amplifier with the output voltage being directly proportional to the magnetic field passing through the Hall sensor. Linear or analogue sensors give a continuous voltage output that increases with a strong magnetic field and decreases with a weak magnetic field. In linear output Hall sensors, as the strength of the magnetic field increases the output signal from the amplifier will also increase until it begins to saturate by the limits imposed on it by the power supply. Any additional increase in the magnetic field will have no effect on the output but drive it more into saturation.

In one aspect of the technology, digital output sensors have a Schmitt-trigger with built in hysteresis connected to the operational amplifier. When the magnetic flux passing through the Hall sensor exceeds a pre-set value, the output from the sensor switches quickly between its "OFF" condition to an "ON" condition without any type of contact bounce. In one aspect of the technology, the disk comprises bipolar and/or unipolar Hall sensors. Bipolar sensors require a positive magnetic field (south pole) to operate and a negative field (north pole) to release while unipolar sensors require only a single magnetic south pole to both operate and release them as they move in and out of the magnetic field.

In one aspect of the technology, the disk or ring and Hall sensor are oriented for head-on detection and/or sideways detection. Head-on detection requires that the magnetic field be perpendicular to the Hall sensor and that for detection, it approaches the sensor straight on towards the active face. In a linear sensor, the output represents the strength of the magnetic field; which is the magnetic flux density, as a function of distance away from the Hall sensor. The nearer and therefore the stronger the magnetic field, the greater the output voltage and vice versa. Linear devices can also differentiate between positive and negative magnetic fields. Non-linear devices can be made to trigger the output "ON" at a pre-set air gap distance away from the magnet for indicating positional detection. Sideways detection requires moving the magnet across the face of the Hall sensor in a sideways motion. Depending on the position of the magnetic field as it passes by the zero field center line of the sensor, a linear output voltage representing both a positive and a negative output can be produced. This allows for directional movement detection which can be vertical as well as horizontal.

In one aspect of the technology, a disk or ring comprises a single magnet disposed therein and a single unipolar sensor disposed adjacent a top or bottom portion of the disk or ring. In this aspect, the unipolar sensor acts as a binary switch that sends an "on/off" signal to the PCB. Upon receipt of a signal, on or off, the PCB changes the light mode of the lighting device from its last known mode to the next sequential mode for which it is programmed. For example, if the light modes in the lighting device include a sequence form low to medium, to high and the last operating light mode was low, when the magnet passes by the sensor, the device would advance to a medium power setting. In this aspect, the disk or ring is constraint to move approximately less than 45 degrees left or right so that actuation occurs without rotating the disk or ring about its entire axis. In another aspect, because it would be inefficient to turn a dial or disk an entire rotation to pass the magnet across the sensor face, the magnet can be disposed on a simple slide that moves back and forth across the face of the sensor.

In another aspect, a disk or ring comprises a plurality of magnets, the disk or ring disposed adjacent a bipolar sensor. In this aspect at least two magnets are disposed on the disk or ring, each having a different polarization to activate the sensor. In this aspect, rotation of the disk is also constrained to approximately less than 45 degrees so that actuation may occur without rotating the disk or ring about its entire axis.

In another aspect, a disk or ring comprises a plurality of magnets disposed about a top and/or bottom of the disk or ring. In this aspect, one or more sensors are disposed adjacent the top and/or bottom of the disk or ring. In an aspect where the sensors comprise unipolar Hall sensors, magnets disposed on opposing side of the right are placed in an offset vertical orientation with respect to one another. Meaning, one magnet is not directly on top of, or beneath another magnet. In this fashion, two Hall sensors may be oriented substantially horizontally close to one another if they were in the same plane; a first magnet interacting with a first sensor to generate a first signal and a second magnet interacting with a second sensor to general a second signal.

Figure 9:
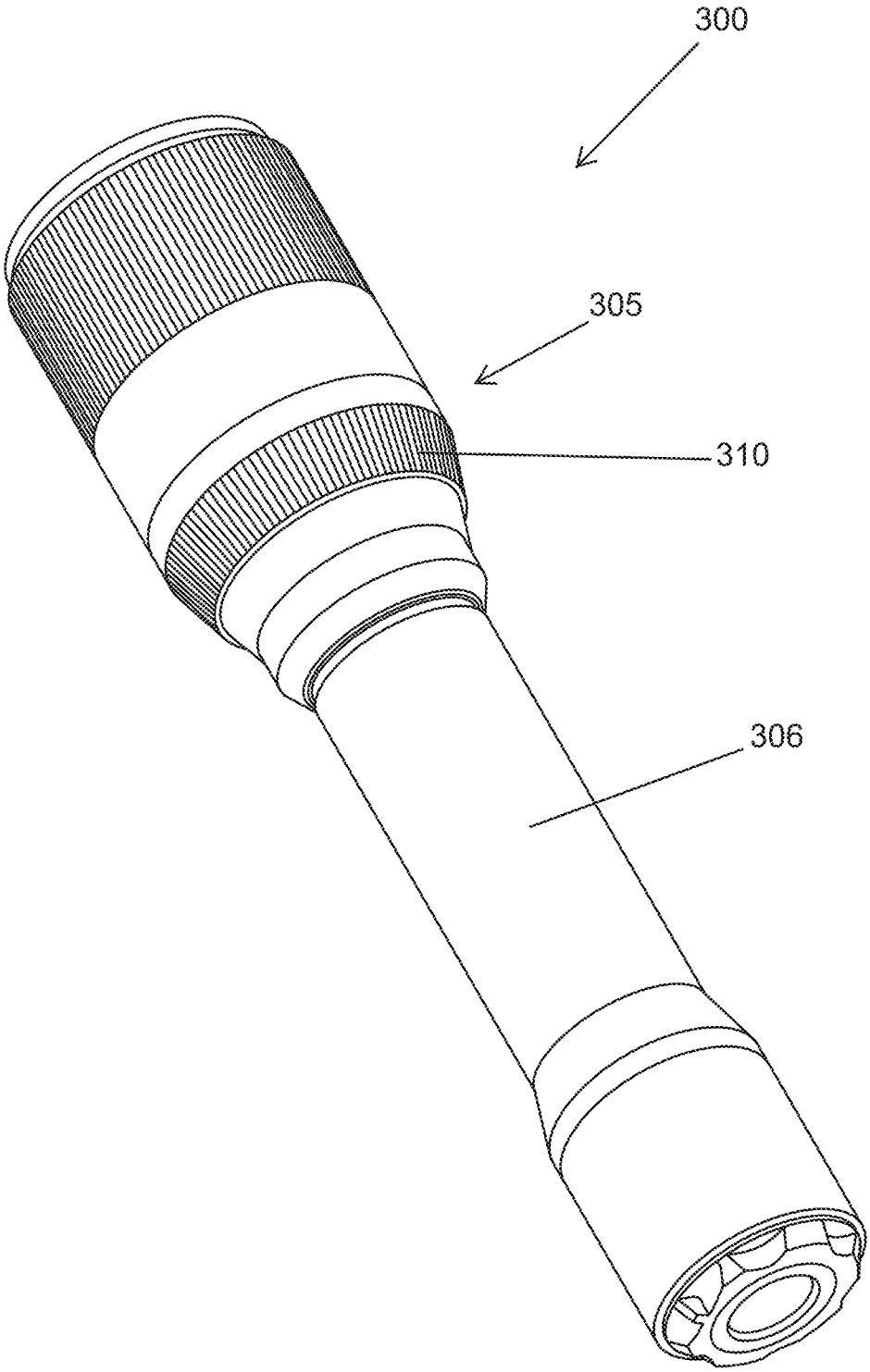
FIG. 9 is a perspective view of a lighting device in accordance with one aspect of the technology.
Figure 10:
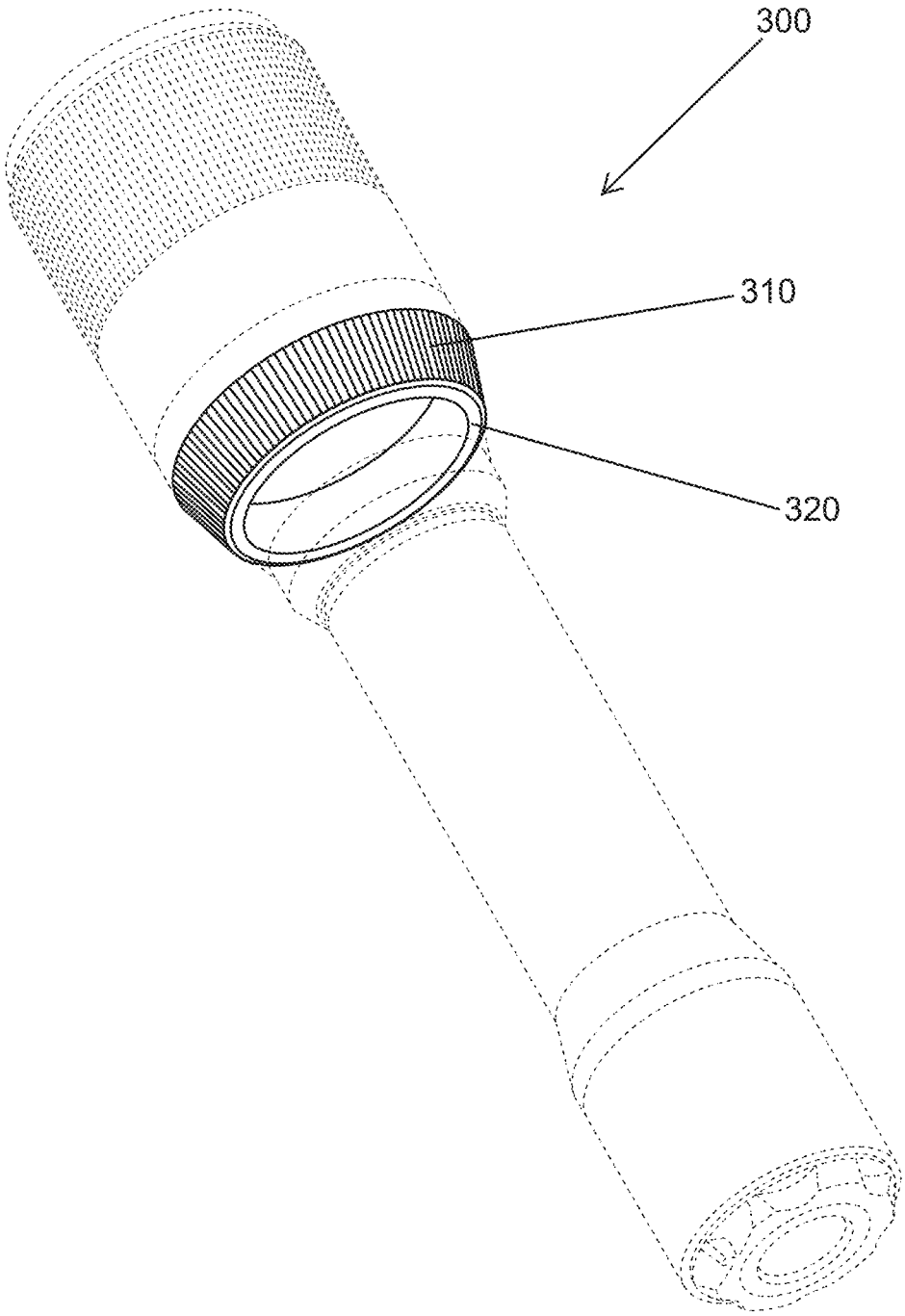
FIG. 10 is a perspective view of a lighting device in accordance with one aspect of the technology.
Figure 11:
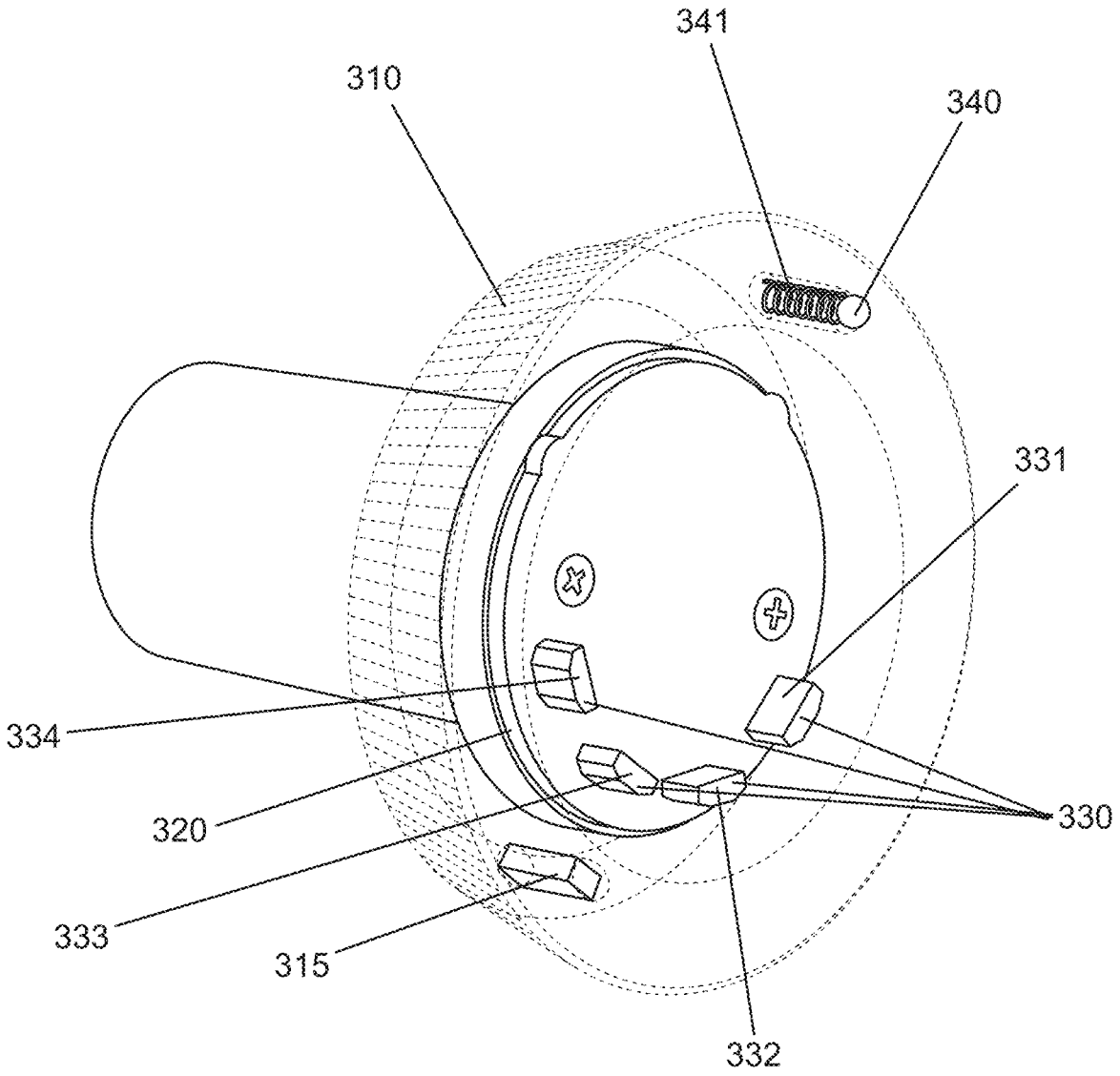
FIG. 11 is a cross section view of a portion of a lighting device in accordance with one aspect of the technology.

With reference to FIGS. 9-11, in one aspect of the technology, a lighting device 300 is disclosed with comprising a ring 310 disposed about an exterior of the lighting device 300 near a distal portion 305 of the handle 306. The ring 310 is configured to rotate about the exterior of the lighting device 300. The ring 310 comprises at least one magnet 315 disposed an interior edge or side portion of the ring 310. A stationary PCB 320 is disposed within the center of the ring 310 comprising a plurality of sensors 330. When the ring 310 is moved circumferentially about the PCB 320 and the magnet 315 passed by one of the sensors 330, the sensor generates an output signal to the PCB 320. In one aspect of the technology, each of the four sensors operates to switch the power mode of the lighting device. As an example only, when the magnet 315 passes by sensor 331 the lighting device 300 is switched into a low power mode. When the magnet 315 passes by sensor 332, the lighting device 300 is switched into a medium power mode. When the magnet 315 passes by sensor 333, the lighting device 300 is switched into a high power mode. When the magnet 315 passes by sensor 334, the lighting device switches to a strobe function. A ball 340 coupled to a spring 341 is disposed about a portion of the ring 310, the ball 340 being configured to engage one or more divots or depressions in the lighting device 300. In this manner, the ring 310 is frictionally engaged at different positions about the lighting device 300 corresponding to the different power modes. In one aspect, when the lighting device 300 switches from one power mode to another, the load transition rate is regulated to minimize the draw of power during the transition. While reference is made to 4 sensors, it is understood that in another aspect, the lighting device 300 comprises more or fewer sensors and more or fewer magnets. In an additional aspect, the lighting device 300 is configured so that one or more sensors are configured to activate different light sources including light sources propagating different wavelengths of light.

Figure 12:
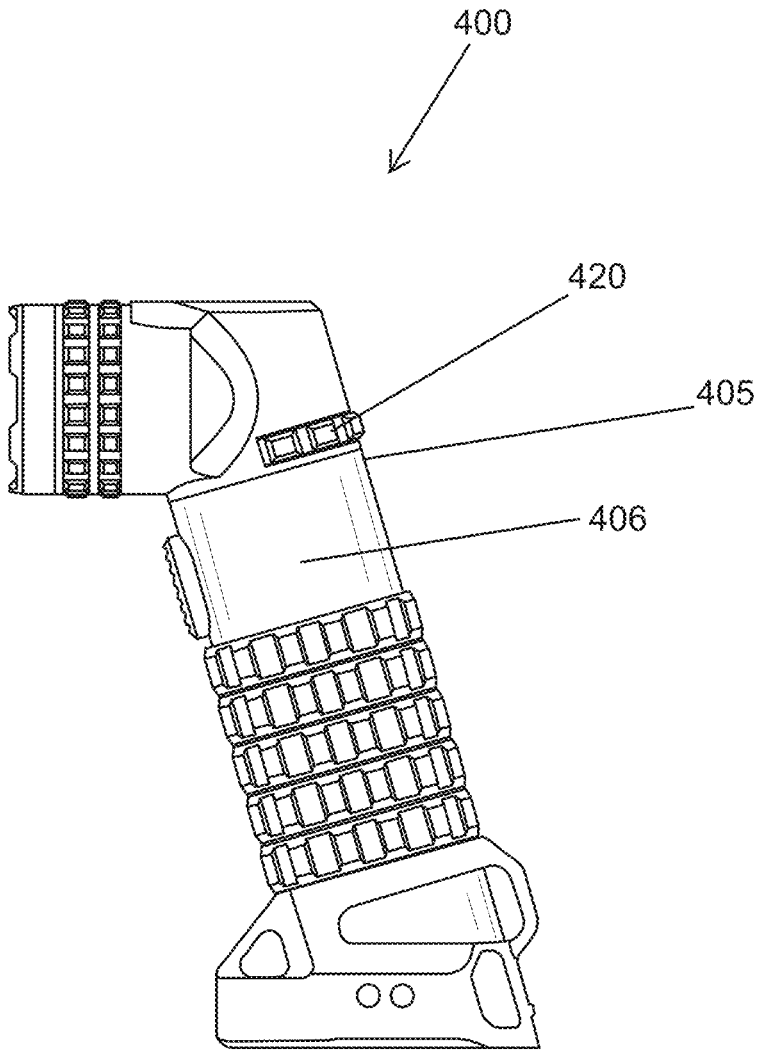
FIG. 12 is a perspective view of a lighting device in accordance with one aspect of the technology.
Figure 13:
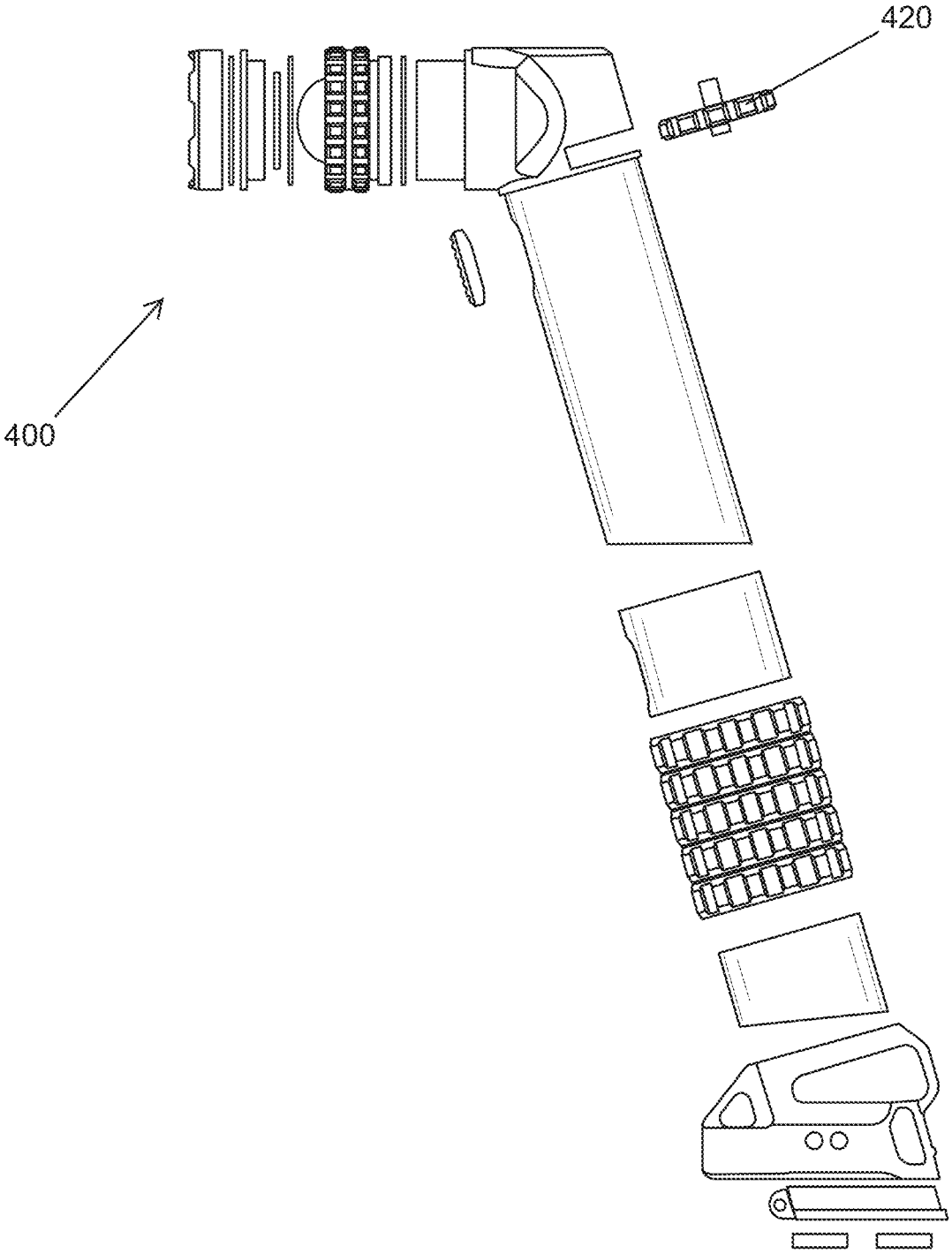
FIG. 13 is an exploded perspective view of a lighting device in accordance with one aspect of the technology.
Figure 14:
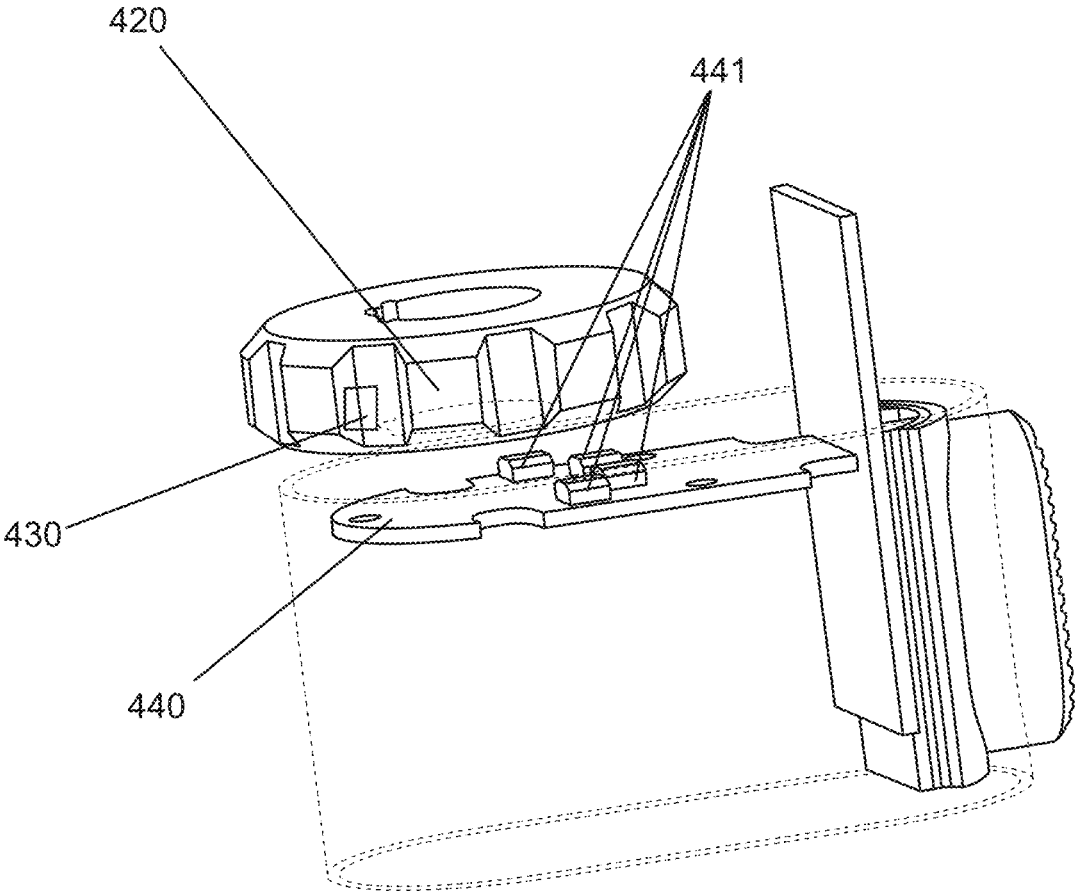
FIG. 14 is a cross section view of a portion of a lighting device in accordance with one aspect of the technology.

With reference to FIGS. 12-14, a lighting device 400 is disclosed comprising a ring 420 disposed about a back distal side 405 of a handle 406 of the lighting device 400. The ring 420 is partially disposed within an interior of the handle 406. The ring 420 comprises one or more magnets 430 disposed about a bottom portion of the ring 420, the face of the magnet 430 oriented in downward direction. In one aspect, a PCB 440 is disposed beneath the ring 420 with one or more sensors 441 on a top portion of the PCB. In this aspect, as the ring 420 is rotated, the magnet 430 passes by the sensors 441, causing each sensor to generate an output signal as the magnet passes by the sensor 441. In another aspect, a magnet is disposed on a top portion of the ring 420 and a PCB and/or sensors are disposed above the ring 420. In still another aspect, magnets are disposed about top and bottom portions of the ring 420 corresponding to sensors disposed above and below the ring 420.

In one aspect, a sensor "group switch" is located about the lighting device 400 permitting the user to change which of a plurality of sensors are being activated. For example, a top group of sensors (i.e., sensors above the ring 420) are configured to change the power modes of the lighting device whereas a bottom group of sensors (i.e., sensors below the ring 420) are configured to change the wavelength of light being propagated from the lighting device. A first switch changes which group of sensors will be active when the ring 420 is rotated, causing one or more magnet to pass by a corresponding sensor. Groups of sensors that are activated by the switch need not be physically grouped in the same location (i.e., all above or all below the ring). In one aspect, a plurality of sensor are disposed beneath the ring 420 and the "group switch" switches between first and second sub groups of the plurality for activation.

The foregoing detailed description describes the technology with reference to specific exemplary aspects. However, it will be appreciated that various modifications and changes can be made without departing from the scope of the present technology as set forth in the appended claims. The detailed description and accompanying drawing are to be regarded as merely illustrative, rather than as restrictive, and all such modifications or changes, if any, are intended to fall within the scope of the present technology as described and set forth herein.

More specifically, while illustrative exemplary aspects of the technology have been described herein, the present technology is not limited to these aspects, but includes any and all aspects having modifications, omissions, combinations (e.g., of aspects across various aspects), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus-function are expressly recited in the description herein. Accordingly, the scope of the invention should be determined solely by the appended claims and their legal equivalents, rather than by the descriptions and examples given above.

The invention claimed is:

1. A method of operating a lighting device, comprising:

(i) operating a lighting device comprising first and second control switches, first and second light source, each light source having first and second power modes;

(ii) moving a first magnet past a first sensor to generate a first signal, said first signal changing the power mode of the first light source from a first power mode to a second power mode;

(iii) moving a second magnet past a second sensor to generate a second signal, said second signal changing the power mode of the second light source from a first power mode to a second power mode.

2. The method of claim 1, wherein the first power mode comprises a pulse width modulation duty cycle ranging from 70% to 80%.

3. The method of claim 1, wherein the second power mode comprises a pulse width modulation duty cycle ranging from 20% to 30%.

4. The method of claim 1, wherein the lighting device comprises a primary light source and a status indicator light source, wherein the status indicator light source is configured to propagate light ranging from 625 nm to 740 nm, 500 nm to 565 nm, or 450 nm to 485 nm.

5. The method of claim 4, further comprising increasing the duty cycle of the status indicator light source from a first pulse width modulation duty cycle ranging from 20% to 40% to a second pulse width modulation duty cycle ranging from 50% to 70%.

6. The method of claim 4, further comprising increasing the duty cycle of the status indicator light source from a first pulse width modulation duty cycle of 30% to a second pulse width modulation duty cycle of 60%.

7. The method of claim 1, wherein the first and second magnets are disposed about a curvilinear plate rotatably mounted about a portion of a handle of the lighting device.

* * * * *